United States Patent [19]

Egaas

[11] Patent Number: 4,792,120

[45] Date of Patent: Dec. 20, 1988

[54] POST REMOVING DEVICE

[76] Inventor: Roy B. Egaas, 11330 Madison Ave. NE., Bainbridge Island, Wash. 98110

[21] Appl. No.: 123,217

[22] Filed: Nov. 20, 1987

[51] Int. Cl.[4] ..... E21B 19/00

[52] U.S. Cl. ..... 254/30; 29/254; 254/131

[58] Field of Search ..... 254/29 A, 29 R, 30, 254/31, 120, 129, 131, 133 R; 29/254, 275; 81/463

[56] References Cited

U.S. PATENT DOCUMENTS

| | | | |
|---|---|---|---|
| 3,122,354 | 2/1964 | Redeback | 254/131 |
| 3,734,463 | 5/1973 | Enright | 254/30 |
| 3,991,976 | 11/1976 | Skinner | 254/132 |
| 4,454,792 | 6/1984 | Burris | 29/254 |
| 4,459,729 | 7/1984 | Volkmann | 254/30 |

*Primary Examiner*—Frederick R. Schmidt
*Assistant Examiner*—Judy J. Hartman
*Attorney, Agent, or Firm*—George M. Cole

[57] ABSTRACT

Device (10) for extacting and pulling posts, poles and the like having a tool body portion (12) including a back wall (16), side walls (22,24) and lower end surfaces (20,30,32). A hollow handle (14) extends upwardly from the tool body (12) and includes a slug metal member (50) at the lower end of the handle. Teeth (38,40) are secured to the lower edge surface of the back wall. A slide hammer bar (60) is adapted to be inserted in the hollow handle (14) to pound the tool body down and to pound the teeth into engagement with the post. The bar also acts as a lever extension of the handle for prying the post up once the device has been position and engaged with the post.

4 Claims, 2 Drawing Sheets

POST REMOVING DEVICE

DESCRIPTION

TECHNICAL FIELD

The invention relates to the field of devices for pulling and removing posts and poles from the ground, and more particularly to a device which enables removal of a post or the stub of a post or pole from the ground.

BACKGROUND ART

As those skilled in the art are aware various governmental agencies such as cities, counties and states have long been plagued by the need for means to anchor sign posts and the like. With devices now available for detachably anchoring posts the need has arisen for a device which can also rapidly pull a post or the stub of a damaged, vandalized or broken post or pole. For instance, when a post is broken so that a stub must be removed, the amount of effort and time required of workmen becomes substantial and thus the expense may be prohibitive. Generally, the stub must be dug out particularly if an anchoring device is secured to the post below ground level. Where workmen have had a stub to remove from the ground one practice has been to screw a heavy eye bolt into the broken stub and then insert a bar or other heavy pry device through the eye and leverage the stub out of the ground. Where an anchoring device is attached more digging than normal is required of the crew. Even where there is no anchoring means or where an entire post must be removed digging is still required even though to a lesser extent. Accordingly, governmental entities incur large annual expenses for labor, post material, sign maintenance, and post repair and replacement.

Applicant is not aware of any prior art patents which relate to the invention herein described and claimed.

SUMMARY OF THE INVENTION

The invention comprises an elongated tool which includes a back and two side sections or plates to form a U-shaped cross section. At the lower end of the tool back plate are a pair of heavy teeth which are bent inwardly to extend inwardly beyond the plane of the inside surface of the back. Extending upwardly from the back plate is a hollow handle which is welded to the back. At the lower end of the hollow handle is a predetermined thickness of metal against which a round iron hammer slides and pounds in order to drive the tool down into the ground. The bar is then used to drive the teeth of the tool into the post or post stub at the desired angle and assists in leveraging the handle of the tool down to the ground. The force will pull the post or stub upwardly. The operation may have to be repeated several times in order to force the post or stub free.

Accordingly, it is among the many features and advantages of the invention to provide a post and stub removal or extractor tool that is uniquely simple, rugged and effective. The device enables a workman to exert an enormous upward component force on the post or stub and thus virtually eliminates digging. Enough upward force is generated by the device so that any anchoring means attached under ground to the tub is left there and the stub is pulled free. The invention is effective enough so that posts or stubs of posts can be pulled free from hardpan clay and black top surfaces.

The extractor device of the invention shortens workman time and is durable and relatively inexpensive.

BEST MODE FOR CARRYING OUT THE INVENTION

Figure 1:
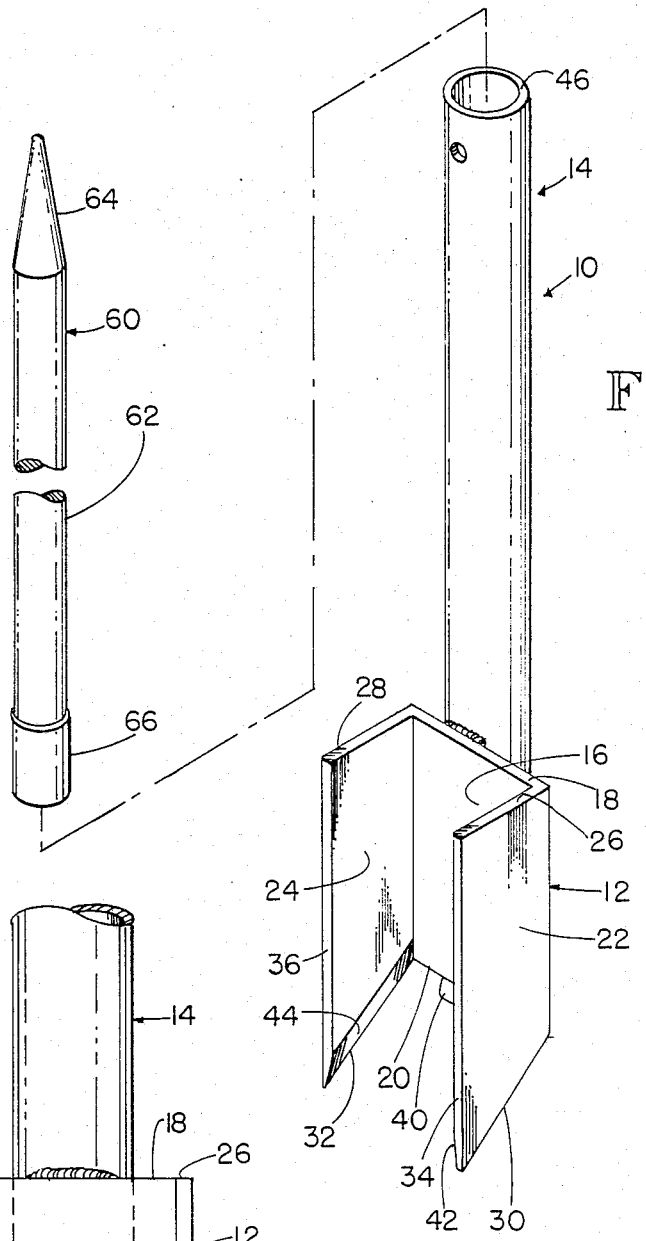
FIG. 1 is an exploded view in perspective showing the tool of this invention and the hammer bar used therewith.

Referring now to the drawings it will be seen that the device, generally designated by the number 10, has a post gripper or tool section generally referred to by the number 12 and a handle portion generally referred to by the number 14. The tool portion 12 has a generally rectangular back wall 16 with upper edge 18 and lower edge 20. Side wall plates 22 and 24 are attached to the side edges of the back wall and extend forwardly at right angles to the back wall and generally parallel to each other. Note that the upper edges 26 and 28 of the side walls are flush with upper edge 18 of the back wall. Lower edges 30 and 32 of the side walls angle upwardly from the front edges 34 and 36 to join lower edge 20 of the back wall. The angle of lower edges 30 and 32 forces the tool to move toward the post to maintain its proper position. The tool portion of the device is, for illustrative information only, approximately nine inches long along the front edges 34 and 36 and approximately seven inches long on the back plate or wall 16. The overall width is about four and a quarter inches and the depth of side walls 22 and 24 is about three inches from front edges 34 and 36 to back wall 18.

Figure 2:
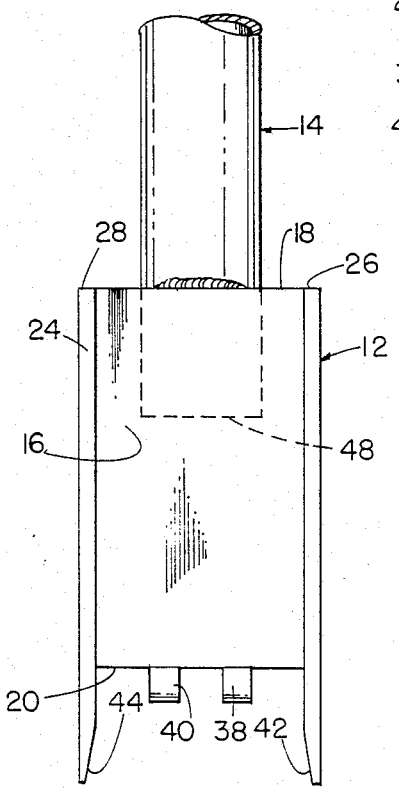
FIG. 2 is a partial front elevation view of the extractor tool showing additional details of its construction.
Figure 3:
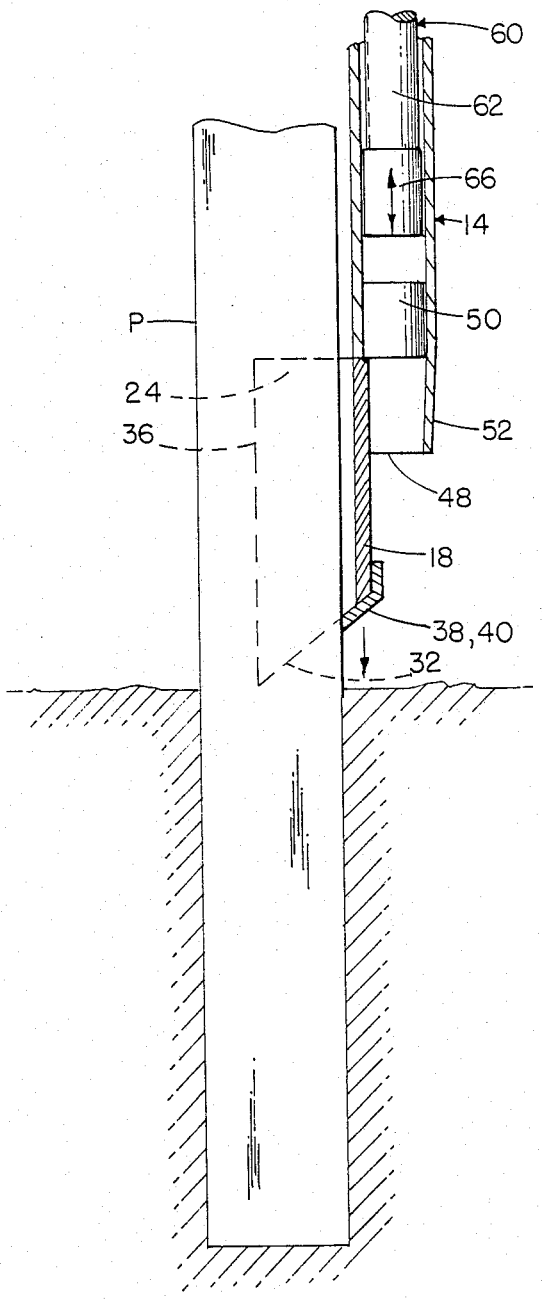
FIG. 3 is a partial cross sectional view in elevation showing additional details of construction and the manner of its usage.
Figure 4:
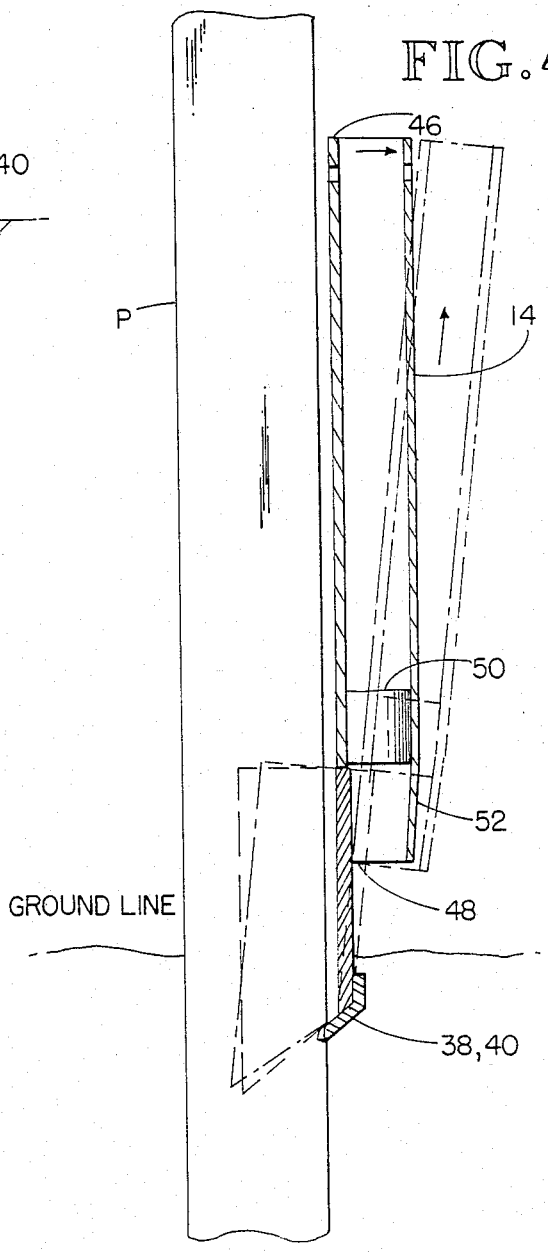
FIG. 4 is a cross section view in elevation showing additional details of construction and use of the invention.

Two teeth are welded to the outside of back wall 18 and extend downwardly and inwardly as shown in FIGS. 2, 3 and 4. The teeth are approximately two inches long by one-half inch in width and one-quarter inch thick. The number of teeth 38 and 40 attached to the device is a matter of design preference but two such teeth have found to be effective. Again the dimensions are given for illustrative purposes and not for specific limitations. The tool portion 12 of the device shows that the lower edges 30 and 32 are beveled on the inside surface to facilitate hammering of the tool into the ground.

The handle portion 14 has upper end 46 and lower end 48 and is made of a length of pipe approximately nineteen inches long with a one-eighth inch thick wall and a diameter of one and seven-eighths inches. The handle 14 is welded to the back of the tool portion as shown so that the handle is well secured to the tool portion. A thick bottom slug 50 of metal is located and secured near the lower end 48 on the inside of the handle. Note that the lower end portion 52 of the handle between slug 50 and lower end 48 is crimped slightly since the slug forms the hammering surface by which the device is pounded into the ground.

A hammer bar generally designated by the number 60 is approximately five feet long and has elongated body 62, upper tapering end 64 and hammer end or head 66 which is of a slightly large diameter than the bar body 62.

In use the device is placed next to a sign post or stub P which is typically a 4-by-4 wooden member such that the side walls 22 and 24 straddle the post. Hammer bar 60 is then inserted into the handle 14 and pounded down on the slug 50 until the lower ends of edges 30 and 32 are about three inches deep or below the ground or surface line. The bar is then used to pull the bar outwardly away from the post until it and the handle of the device are at approximately a forty-five degree angle. The bar is then used again as a slide hammer to drive the teeth 38 and 40 into post P. Using the bar 60 to create leverage, the device 10 is pushed down to the ground to force the post upwardly. The process is repeated until the post is released from any anchoring device and/or until it is loose enough to be pulled free. With the dimensions described above it will be appreciated that the device itself weighs about thirty-seven pounds while the slide bar hammer weighs about nineteen pounds. With the bar inserted in the handle the lever force transmitted to the teeth for pulling the post upwardly is in the order of roughly two thousand pounds. The bar may be moved outwardly in the handle by an additional approximately twelve inches to gain more leverage if needed.

I claim:

1. Pulling and extracting device for posts, poles and the like, comprising:

(a) a tool portion including a post engagement member having a back wall and spaced apart side walls extending outwardly from said back wall such that a generally U-shaped tool body is defined having upper edge means and lower edge means, said tool body further including post engaging teeth means attached to the lower edge means of said back wall and extending downwardly below said lower edge means, (b) elongated, hollow handle means secured to said back wall of said tool body and having an upper and a lower end and extending upwardly from said tool body and including metal slug means inside said handle near the lower end thereof, and (c) slide bar hammer means adapted to be inserted in said handle means and to be hammered against said metal slug means for driving said tool portion downwardly and to drive said teeth means into said post, said slide bar hammer also serving as a lever extension of said handle for prying said post upwardly when the teeth means have been engaged therewith.

2. The post pulling and extracting device according to claim 1 and wherein said spaced apart side walls of said tool body are longer than said back wall and have lower edge surfaces which angle upwardly and rearwardly from the front edges to the lower edge means of said back wall.

3. The post pulling and extracting device according to claim 2 and wherein the lower edge surfaces of said spaced apart side walls are tapered for easier penetration of the material in which said post is embedded.

4. The post pulling and extracting device according to claim 3 and wherein said teeth means attached to said back wall are two in number and angle forwardly at a predetermined angle.

* * * * *